US005230474A

United States Patent [19]

Yamaguchi et al.

[11] Patent Number: 5,230,474

[45] Date of Patent: Jul. 27, 1993

[54] MILL INERT APPARATUS FOR COAL PULVERIZER AND METHOD FOR PREVENTION OF EXPLOSION

[75] Inventors: Yoshiki Yamaguchi; Masaaki Kinoshita; Shozo Kaneko; Hidenori Sakamoto, all of Nagasaki, Japan

[73] Assignee: Mitsubishi Jukogyo Kabushiki Kaisha, Tokyo, Japan

[21] Appl. No.: 704,324

[22] Filed: May 23, 1991

[30] Foreign Application Priority Data

May 25, 1990 [JP] Japan ..... 2-133918
May 25, 1990 [JP] Japan ..... 2-133919

[51] Int. Cl.[5] ..... B02C 21/00

[52] U.S. Cl. ..... 241/31; 241/18; 241/DIG. 14

[58] Field of Search ..... 241/18, 31, DIG. 14

[56] References Cited

U.S. PATENT DOCUMENTS 4,778,113 10/1988 Jewett et al. ..... 241/DIG. 14

FOREIGN PATENT DOCUMENTS 131695 7/1984 Japan ..... 241/DIG. 14

*Primary Examiner*—Douglas D. Watts
*Attorney, Agent, or Firm*—Anderson Kill Olick & Oshinsky

[57] ABSTRACT

A mill inert apparatus for preventing the explosion of a mill inert apparatus which comprises a drain separator and a drain trap for separating and removing drain contained in an inert vapor, and a drain discharge route for discharging the separated drain. Furthermore, a method for preventing the explosion of a coal pulverizer which comprises the step of introducing an inert medium into the coal pulverizer in specific operation stages so that an oxygen concentration in the coal pulverizer may be in the range of from 13% to 15%.

3 Claims, 4 Drawing Sheets

MILL INERT APPARATUS FOR COAL PULVERIZER AND METHOD FOR PREVENTION OF EXPLOSION

BACKGROUND OF THE INVENTION

1. Field of the Invention

The present invention relates to a mill inert apparatus for a coal pulverizer in which an inert medium is introduced into a coal pulverizer for pulverizing coal to lower an oxygen concentration in the coal pulverizer, whereby the explosion of the pulverized coal is prevented, and it also relates to a method for preventing the explosion.

2. Description of the Related Art

In recent years, there has been a tendency to use coal containing a large amount of ignitable and volatile components in pulverized coal-fired boilers. If such an ignitable coal is pulverized in a coal pulverizer, the explosion of the pulverized coal is particularly liable to occur. In order to prevent this explosion, a mill inert apparatus and a mill inert method which are used in an inert medium, such as $N_2$, $C0_2$ or a vapor, is introduced into the coal pulverizer for lowering the oxygen concentration in the coal pulverizer.

FIG. 4 shows the construction of this kind of mill inert apparatus. Reference numeral 1 is a coal feeding device for feeding coal, and numeral 2 is a coal pulverizer for pulverizing the coal fed from the coal feeding device 1. The coal, which has been pulverized to a predetermined particle size in the coal pulverizer 2, is dried by hot air introduced through a hot air duct 3, and is then forwarded to a burner 10.

Also, numeral 11 is a vapor line extending from a boiler, and a vapor led to a branch from this vapor line 11 is used as the inert medium. The inert medium led into the branch is forwarded via a pressure-reducing valve 4 and a temperature-lowering device 5 to reduce the pressure and to lower the temperature of the inert medium, and the thus regulated inert medium is then introduced into the coal pulverizer 2 through the above-mentioned hot air duct 3.

The amount of the inert vapor introduced into the coal pulverizer 2 through the hot air duct 3 is controlled by an orifice 12 disposed on the downstream side of the temperature-lowering device 5.

Furthermore, the amount of the hot air introduced into the coal pulverizer 2 through the hot air duct 3 is metered by an orifice 13 disposed on the hot air duct 3, and then controlled by a damper 14 disposed on the upstream side of the orifice 13 in the hot air duct 3 in accordance with a metered result.

This mill inert apparatus has the drawback that when the inert vapor led from the vapor line 11 is forwarded via the pressure-reducing valve 4 and the temperature-lowering device 5 to reduce the pressure and to lower the temperature of the inert medium, the vapor reaches a saturated state and generates a liquid which herein will be called drain. If directly introduced into the coal pulverizer 2, the drain has a bad influence on cast parts in the coal pulverizer 2, so that these cast parts may be damaged.

Moreover, in the above-mentioned conventional mill inert method, the desired oxygen concentration obtained by dilution with the inert medium is set to a range of from 7 to 11%. However, since this oxygen concentration level is too low, a large amount of the inert medium is consumed, so that annexed facilities are excessively required. In addition, the combustion of the burner may become unstable, and there is a risk that fire extinction or the like occurs.

Furthermore, in the conventional technique, a CO concentration in the coal pulverizer is detected by means of a CO meter, and when the CO concentration exceeds a predetermined value, the inert medium is fed. Therefore, the CO meter tends to be worn and clogged with the inert medium to diminish the reliability of the CO meter.

SUMMARY OF THE INVENTION

In view of the above-mentioned situation, the present invention has been developed, and an object of the present invention is to provide a mill inert apparatus which can protect cast parts in a coal pulverizer from damage.

Another object of the present invention is to provide a method for preventing the explosion of a coal pulverizer by which the amount of an inert medium to be consumed is decreased to minimize necessary annexed facilities, the explosion of pulverized coal is securely prevented without impeding the combustion at a burner, a mechanism for detecting a system condition is omitted to avoid possible troubles at the detecting mechanism, and reliability is improved.

In a mill inert apparatus of the present invention, a drain separator and a drain trap for separating and removing the drain contained in an inert vapor are disposed on the downstream side of a temperature-lowering device on a feed pipe for feeding the inert vapor to a coal pulverizer, and the drain which has been separated and removed by the drain separator and the drain trap is then discharged through a drain discharge pipe which can be opened and closed by remote control. In consequence, the introduction of the drain into the coal pulverizer can be securely prevented.

Furthermore, in a method for preventing the explosion of a coal pulverizer which comprises the step of introducing an inert medium into the coal pulverizer to lower an oxygen concentration in the coal pulverizer and to thereby prevent the explosion of a pulverized coal, the inert medium is sequentially introduced thereinto at the start-up, stop and trip of a coal feeding device for feeding the coal to the coal pulverizer so that the oxygen concentration in the coal pulverizer may be in the range of from 13% to 15%. As a consequence, such an oxygen concentration that prevents the explosion can be securely maintained, and the amount of the inert medium to be consumed can be decreased, so that the necessary annexed facilities can be minimized. In addition, the impediment of the combustion on the burner can be avoided. Moreover, a mechanism for detecting a system condition is omitted to eliminate troubles of the detecting mechanism, and the reliability of the apparatus can be improved.

DETAILED DESCRIPTION OF THE PREFERRED EMBODIMENTS

Now, one embodiment of a mill inert apparatus of the present invention will be described in reference to drawings.

Figure 1:
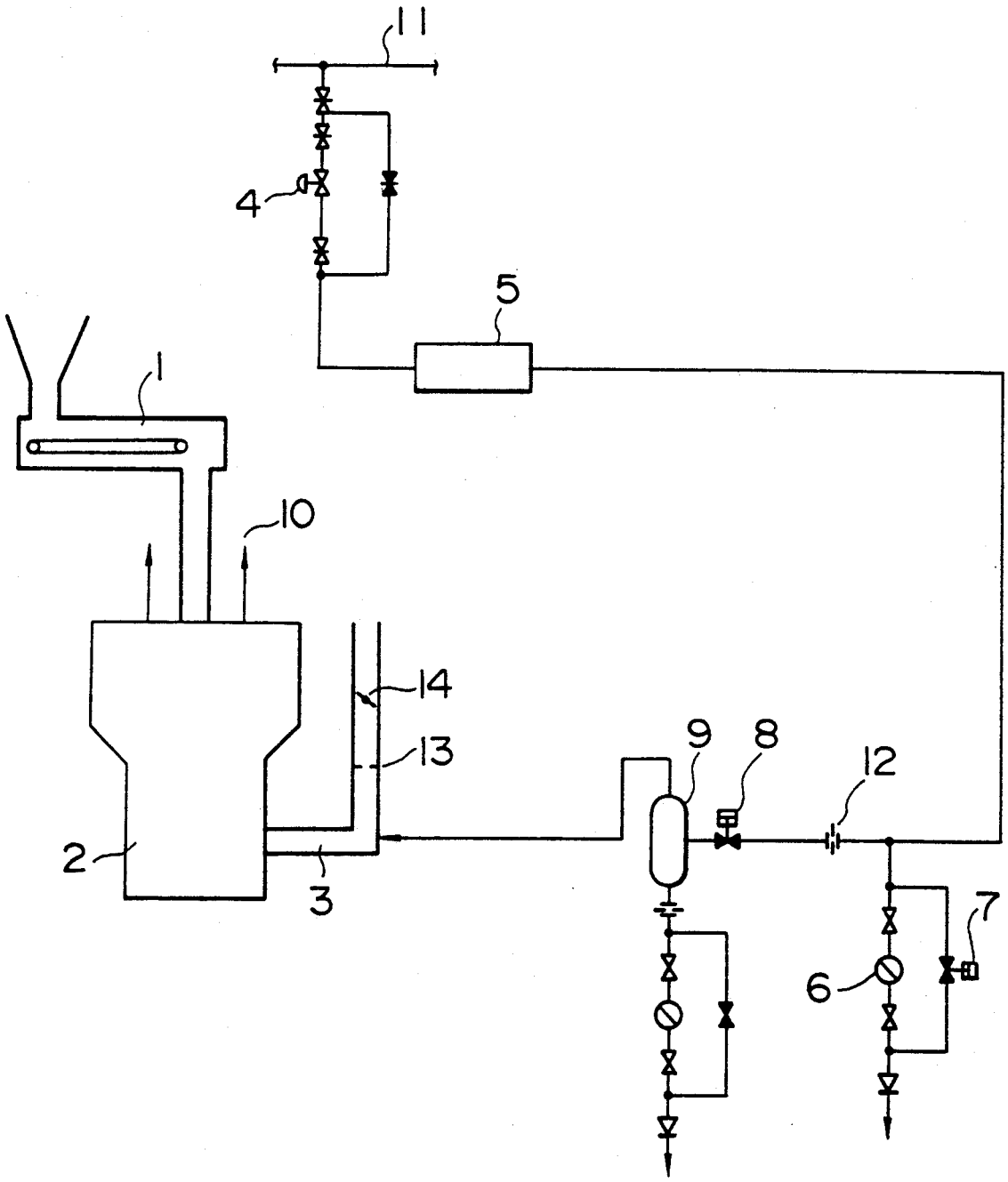
FIG. 1 is a functional block diagram illustrating the constitution of one embodiment of the present invention.
Figure 4:
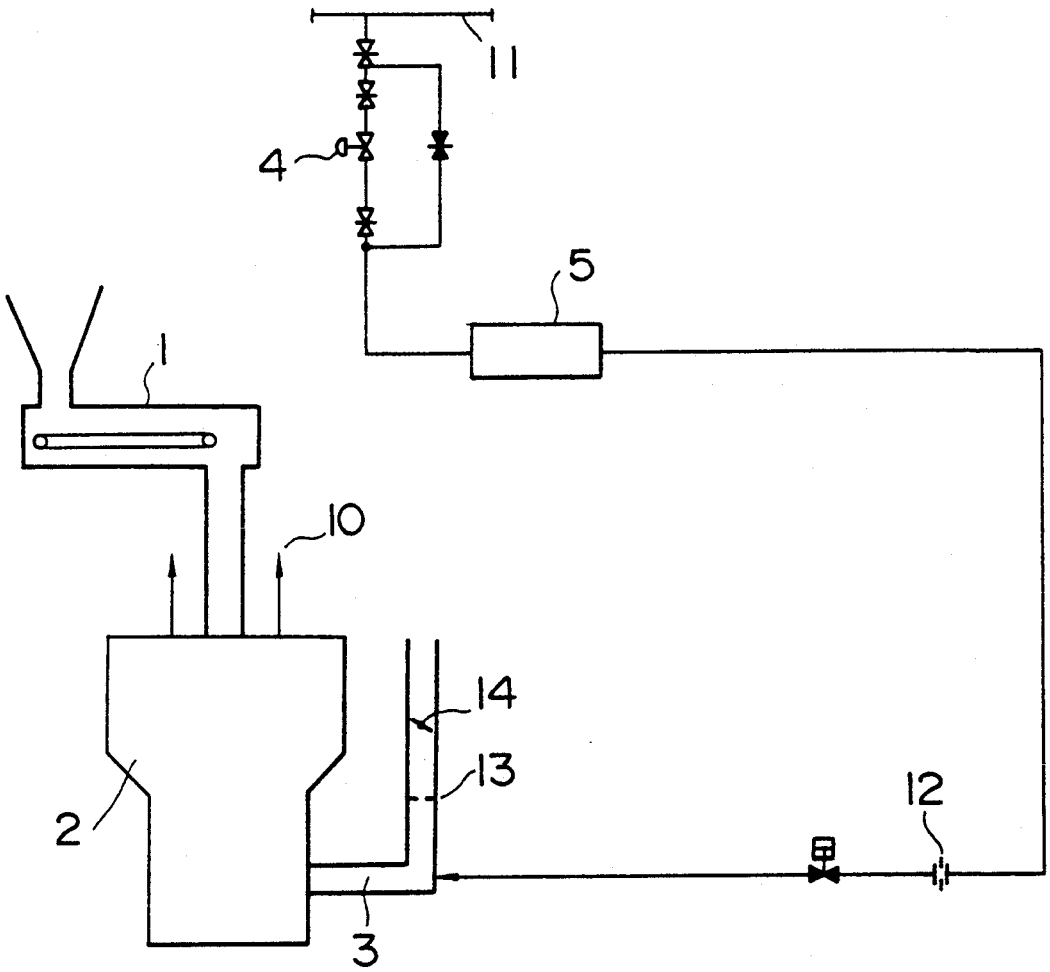
FIG. 4 PRIOR ART
FIG. 4 is a functional block diagram illustrating the constitution of a conventional mill inert apparatus.

FIG. 1 shows the constitution of the mill inert apparatus of the present invention, and its fundamental constitution is the same as shown in the above-mentioned FIG. 4. Therefore, the identical parts will be represented by the identical numbers, and the explanation of these identical parts will be omitted.

Drain in an inert vapor, whose pressure and temperature are reduced and lowered to predetermined pressure and temperature values by a pressure-reducing valve 4 and a temperature-lowering device 5, is partially separated and removed by a drain trap 6 disposed in parallel with a drain discharge valve 7 on the upstream side of an orifice 12 for controlling the amount of the inert vapor. Then, the inert vapor is led to a hot air duct 3 through the orifice 12, an inert vapor valve 8 and a drain separator 9. The inert vapor valve 8 functions to shut out the introduction of the inert vapor into a coal pulverizer 2 during the operation of the coal pulverizer 2. The drain separator 9 functions to securely separate and remove the drain in the vapor which has not been separated by the above-mentioned drain trap 6.

In the above-mentioned construction, when the coal pulverizer 2 is normally operated, the inert vapor valve 8 is closed so that the inert vapor may not be mixed with hot air introduced into the coal pulverizer 2 through the hot air duct 3. Even in this condition, the pressure and the temperature of the inert vapor are reduced and lowered to the predetermined pressure and temperature values by the pressure-reducing valve 4 and the temperature-lowering device 5 so that the introduction of the inert vapor may be begun immediately, if the inert vapor valve 8 is opened. The drain is continuously separated and removed from the inert vapor by the drain trap 6 and the separated and removed drain is directly discharged from the system.

Afterward, if the operation of the coal pulverizer 2 is temporarily stopped, the concentration of the pulverized coal in the coal pulverizer 2 reaches an explosion level. Thus, the hot air which is fed to the coal pulverizer 2 through the hot air duct 3 must be mixed with the inert vapor to lower the oxygen concentration in the coal pulverizer 2.

In this case, prior to opening the inert vapor valve 8, the drain discharge valve 7 which by-passes the drain trap 6 is opened to completely discharge the drain from the vapor on the upstream side of the inert vapor valve 8. Afterward, the inert vapor valve 8 is opened to mix the hot air coming through the hot air duct 3 with the inert vapor, and the mixture is then introduced into the coal pulverizer 2. A drain separator 9 is additionally disposed between the inert vapor valve 8 and the hot air duct 3, and this drain separator 9 also functions to separate and remove the drain from the inert vapor in common with the above-mentioned drain trap 6. Even the drain in the vapor which has not been separated and removed by the above-mentioned drain trap 6 is completely removed from the vapor by means of the thus disposed drain separator 9. Therefore, the drain is never introduced into the coal pulverizer 2, and cast parts in the coal pulverizer 2 can be securely protected from damage by the drain.

According to the mill inert apparatus of the present invention, a drain separator and a drain trap for separating and removing drain from an inert vapor are disposed on the downstream side of a temperature-lowering device on a feed pipe toward the coal pulverizer. The drain which has been separated and removed by the drain separator and the drain trap is then discharged through a drain discharge pipe which can be opened and closed by remote control. In consequence, the introduction of the drain into the coal pulverizer can be prevented, and cast parts in the coal pulverizer can be securely protected from damage.

Furthermore, one embodiment of an explosion prevention method of the present invention will be described with reference to FIG. 1.

In the above-mentioned construction in FIG. 1, a predetermined amount of hot air has already been flowing at the time of the start-up of a coal feeding device 1, and an inert vapor valve 8 is opened in response to the start signal of the coal feeding device 1 to introduce a vapor into the coal pulverizer 2. At this time, an orifice 12 has already been adjusted so that the concentration of oxygen is from 13 to 15% with respect to the amount of the hot air to be fed to the coal pulverizer 2 through a hot air duct 3. After a certain time has passed, the coal feeding device 1 actually begins to operate, and when a certain time has further passed, i.e., when the concentration of the pulverized coal in the coal pulverizer 2 becomes in excess of the upper limit of an explosion concentration, the inert vapor valve 8 is closed, and afterward the coal pulverizer 2 gets into its normal operation.

In the normal stop step of the coal feeding device 1, the inert vapor valve 8 is opened in response to a stop signal of the coal feeding device 1, and the inert vapor is delivered so that the oxygen concentration in the hot air fed to the coal pulverizer 2 may be from 13 to 15%. Furthermore, after a certain time has passed, i.e., after the coal pulverizer 2 has been purged to remove the remaining coal, the inert vapor valve 8 is closed, and the hot air gets into an operating condition for the stoppage.

When the coal feeding device 1 trips, the inert vapor valve 8 is opened in response to the detection of the trip to deliver the inert vapor so that the oxygen concentration in the hot air to be fed to the coal pulverizer 2 may be from 13 to 15%. After the coal pulverizer 2 has been purged to remove the remaining coal, the inert vapor valve 8 is closed, and then the coal pulverizer gets into an operating condition for the stoppage.

Figure 2:
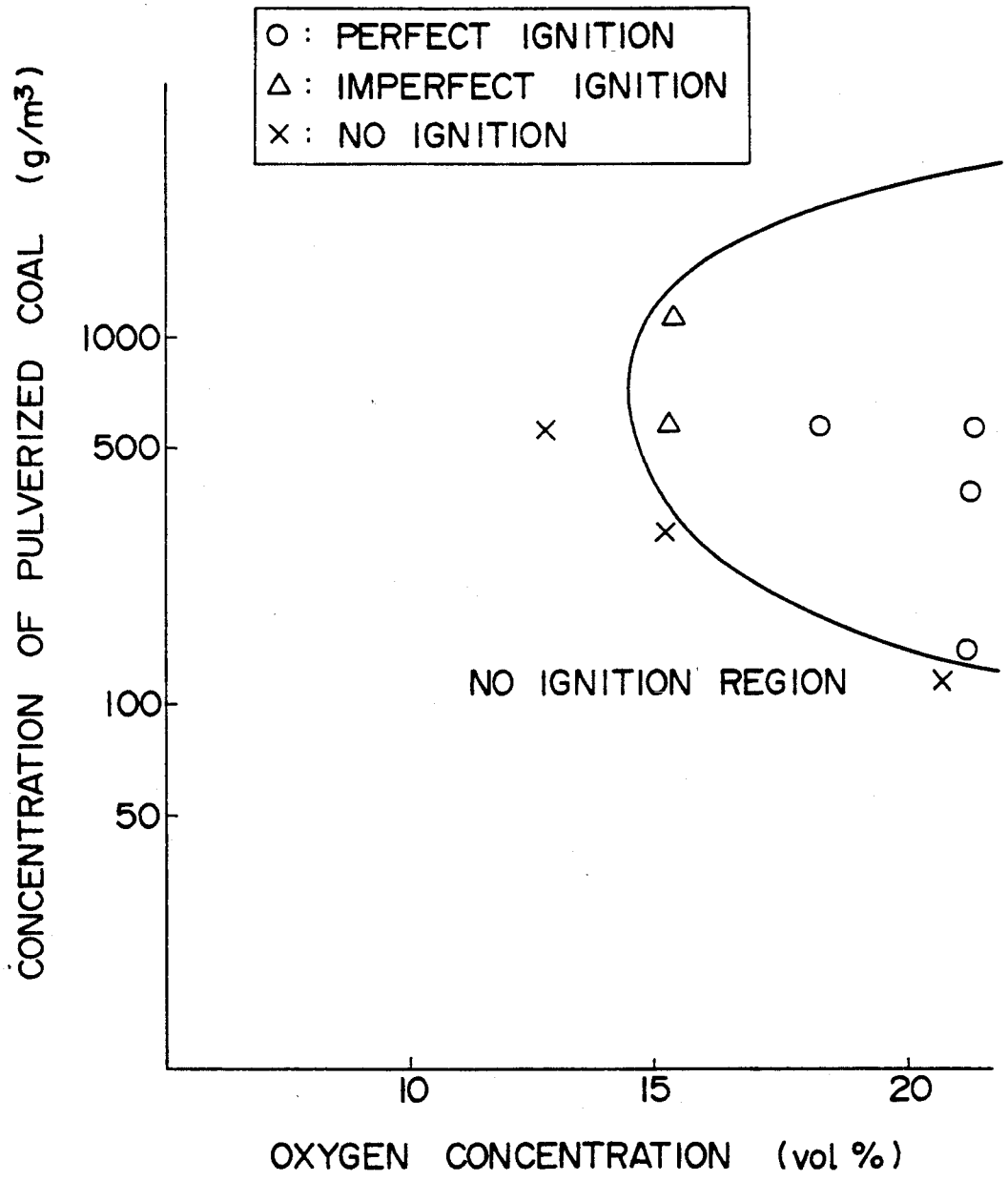
FIG. 2 shows characteristics of explosion in terms of an oxygen concentration and the concentration of a pulverized coal.
Figure 3:
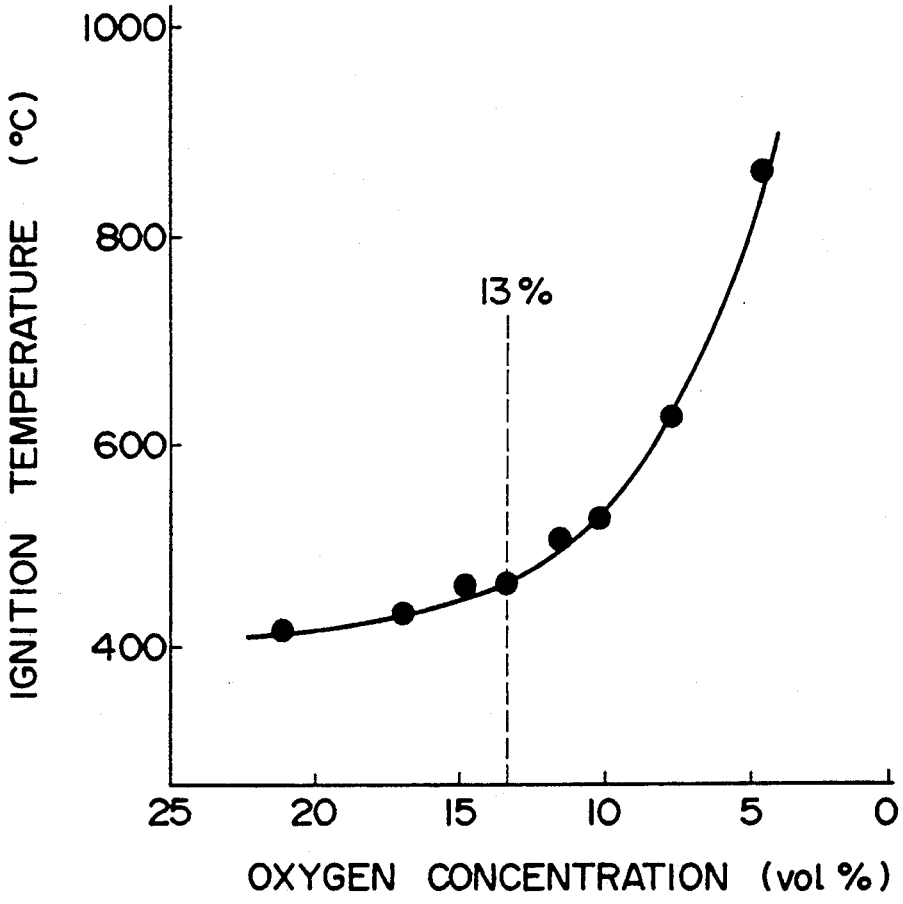
FIG. 3 shows characteristics between the oxygen concentration and an ignition temperature.

With regard to the explosion of the pulverized coal, as a result of a test, characteristics shown in FIG. 2 are obtained. It has been confirmed that even when the concentration of the pulverized coal is higher than the lower limit of the explosion concentration and lower than the upper limit thereof, the explosion does not occur, if the oxygen concentration is 15% or less.

The concentration of the pulverized coal in the coal pulverizer 2 is higher than the upper limit of the explosion concentration at the time of the normal operation, and an explosion does not occur. However, at the time of start-up, stop and trip of the coal feeding device 1, the concentration of the pulverized coal falls temporarily into the extremely explosive range.

Therefore, if the oxygen concentration is controlled to be 15% or less only at the time of start-up, stop and trip of the coal feeding device 1, the explosion in the coal pulverizer 2 can be sufficiently inhibited, and the amount of the inert medium to be consumed can be decreased and the necessary annexed facilities can be minimized.

In addition, ignition temperatures have been tested by changing the oxygen concentration. The results are shown in Table 3. These test results indicate that the gas for delivering the pulverized coal which is the primary air for the combustion does not so much affect the ignition temperature, as compared to the case of delivery only by the use of air, if the oxygen concentration of the gas is 13% or more.

Therefore, if the amount of the inert medium to be introduced is controlled so that the oxygen concentration may be 13% or more, incomplete combustion and fire extinction on a burner can be avoided, with the result that the reliability of the combustion can be maintained.

In view of the above-mentioned points, the amount of the inert vapor to be introduced should be controlled so that the oxygen concentration is in the range of from 13 to 15%.

Also, the present invention is constituted so that the inert vapor is sequentially introduced only at the time of start-up, stop and trip of the coal feeding device 1, at which time the device is in danger of the explosion, without introducing the inert vapor thereinto in response to the detection of the condition of a CO concentration and the like. Therefore, the abovementioned detector is unnecessary, and the reduction in the reliability due to trouble of the detector can be avoided.

Incidentally, in the above embodiment, the vapor is used as the inert medium, but it is not restrictive. Needless to say, $N_2$ or $C0_2$ can also be used as the inert medium.

Furthermore, in the above embodiment, it is described that the orifice 12 for controlling the flow rate of the inert vapor should be adjusted beforehand so that the oxygen concentration may be from 13 to 15% with respect to the predetermined amount of the hot air at the time of the drive start of the coal feeding device 1, but the control of the flow rate may also be carried out by metering the flow rate of the vapor.

In a method for preventing explosion of the present invention which comprises the step of introducing an inert medium into a coal pulverizer for pulverizing a coal to lower an oxygen concentration in the coal pulverizer and to thereby prevent the explosion of the pulverized coal, the inert medium is sequentially introduced into the coal pulverizer at the time of start-up, stop and trip of the coal feeding device for feeding the coal to the coal pulverizer, whereby an oxygen concentration in the coal pulverizer is set in the range of from 13 to 15%.

Therefore, according to the present invention, the oxygen concentration for preventing the explosion is sufficiently maintained, and the amount of the inert medium to be consumed can be decreased and the necessary annexed facilities can be minimized. In addition, it can be avoided to impede the combustion on a burner. A mechanism for detecting the condition can be eliminated, and troubles of such a detector mechanism can be prevented, whereby the reliability of the apparatus can be improved.

As understood from the foregoing, the apparatus and the method of the present invention can be utilized extremely advantageously in the field of the coal pulverizer for pulverizing the coal.

We claim:

1. A mill inert apparatus for introducing an inert vapor into a coal pulverizer to lower an oxygen concentration in the coal pulverizer and thereby prevent explosion of the pulverized coal, said mill inert apparatus, comprising:

an introduction pipe for introducing said inert vapor to the coal pulverizer;

a drain separator and a drain trap for separating and removing drain contained in said inert vapor, said drain separator and said drain trap being disposed on the introduction pipe of said inert vapor; and a drain discharge pipe connected to said drain separator and said drain trap for discharging said drain separated and removed from said inert vapor by said drain separator and said drain trap.

2. The mill inert apparatus according to claim 1, and further comprising remote control means for opening and closing said drain discharge pipe by remote control.

3. A method for preventing explosion of a coal pulverizer which comprises the step of introducing an inert medium into said coal pulverizer for pulverizing a coal to lower an oxygen concentration in said coal pulverizer and to thereby prevent the explosion of the pulverized coal, said method being characterized by introducing said inert medium into said coal pulverizer at start-up, at stop or at trip of a coal feeding device for feeding said coal to said coal pulverizer so that an oxygen concentration in said coal pulverizer may be in a range of from 13% to 15%.

* * * * *